United States Patent [19]

Iwata

[11] Patent Number: 4,631,836

[45] Date of Patent: Dec. 30, 1986

[54] METHOD OF ACTIVATING DOWN AND FIBER MATERIALS

[75] Inventor: Takuzo Iwata, Hirakata, Japan

[73] Assignee: Iwata Co. Ltd., Kyoto, Japan

[21] Appl. No.: 760,615

[22] Filed: Jul. 30, 1985

[30] Foreign Application Priority Data

Apr. 4, 1985 [JP] Japan ..... 60-71360

[51] Int. Cl.[4] ..... F26B 3/10

[52] U.S. Cl. ..... 34/2; 34/12; 34/36

[58] Field of Search ..... 34/2, 36, 1, 12, 210, 34/216, 217

[56] References Cited

U.S. PATENT DOCUMENTS 3,149,906 9/1964 Thorsen ..... 34/36
4,187,615 2/1980 Iwata ..... 34/2

FOREIGN PATENT DOCUMENTS 545189 2/1932 Fed. Rep. of Germany ..... 34/2
56-33482 4/1981 Japan .
428179 4/1975 U.S.S.R. ..... 34/2

*Primary Examiner*—L. I. Schwartz
*Attorney, Agent, or Firm*—Cushman, Darby & Cushman

[57] ABSTRACT

A method of activating down and fiber materials uses a plurality of nozzles for ionized air and nozzles for normal air alternately at proper intervals in the passage of the materials to be treated. The materials are subjected to ionization by ionized air ejected from the nozzles for ionized air produced by an air ionizer connected to the ionized air nozzles. Then the materials are subjected to suspension of the progress of oxydization caused by ozone by normal air ejected from the normal air nozzles. This process is repeated several times while the materials are passing through the passage. The repeated processes of such alternate ionization and suspension of the progress of oxydization caused by ozone allow the materials to be gradually and intensively ionized, resulting in producing finally activated materials which are characteristic of restored bulkiness and elasticity. An enclosure can also be adopted instead of the passage. In the enclosure, the stationary materials are subjected to ionization by ionized air injected. After evacuation of the ionized air from the enclosure, normal air is injected which will be evacuated afterward. One of the uses of this method is activation of down to be filled in quilts. But this method is also utilized for activation of other materials such as cotton, silk, chemical fibers, wool, paper, wood etc.

5 Claims, 5 Drawing Figures

METHOD OF ACTIVATING DOWN AND FIBER MATERIALS

BACKGROUND OF THE INVENTION

FIELD OF THE INVENTION

The present invention relates to a method of activating down and fiber materials, and more particularly to a method of activating down and fiber materials in which ionized air and normal air are alternately brought into contact with materials to be treated continuously so that the surface of the materials is ionized and activated.

DESCRIPTION OF THE PRIOR ART

A conventional method, in which air ionized by corona discharge is blown on down or feathers to neutralize electrostatic charge of the dust attached to the down so that the dust for a down-filled quilt may be removed, is known in Japanese Patent Publication No. 33482/81.

However, the method merely removes dust attached to down, but any further object, operation and effect thereof are not considered.

A quilt filled with cotton shrivels and becomes hard as it is used. The quilt becomes soft and bulky when it is dried in the sun, but when the quilt is used again it becomes thin and hard. The reason why the quilt becomes thin and hard is that cotton fibers are oxidized and lose their original elasticity.

Further, woolen fabrics, silk fabrics, paper or the like also lose their original elasticity and bulkiness as used. It is very difficult to activate such fiber materials which are folded and shriveled.

On the other hand, the feathers and down for down-filled quilts are stuffed into bags imported from South-east Asia. Accordingly, the feathers and down are compressed and intertwined with each other. The feathers and down are further folded in a degreasing process, washing process and drying process. In a process of selecting down from feathers after a dust removel process, the selection ratio of down is as low as about 60% since the shriveled down intertwines about the feathers and fibers. Accordingly, the selection process must be repeated again and again.

The folded and shriveled down can not recover to a sufficiently bulky state. The worn-out down cannot become bulky enough when dried.

SUMMARY OF THE INVENTION

Accordingly, in view of the above problems, it is an object of the present invention to provide a method of activating down and fiber materials through ionization and refreshing folded and shriveled fiber materials. More particularly, it is an object of the present invention to provide a method of activating down and fiber materials, characterized in that a plurality of nozzles for ionized air produced by an air ionizer and nozzles for normal air are alternately disposed at proper intervals in the passage of the materials in order to make said materials go through the passage alternately filled with said ionized air and normal air.

Another method is adopted to achieve the above object. The materials to be treated are accommodated in a chamber, instead of a passage, which is alternately filled with ionized and normal air to repeat the processes where the materials are subjected to ionization and then suspension of the progress of oxydization caused by ozone several times for final activation of the materials.

In accordance with the present invention, a plurality of ionized air nozzles for an air ionizer provided with corona discharging electrodes and normal air nozzles are alternately disposed at proper intervals in the passage of materials to be treated. The passage is filled with ionized air and normal air ejected from the nozzles, and the materials to be treated, for example down, are passed through the passage so that the down is brought into contact with the ionized air for ionization and then brought into contact with the normal air for suspension of the progress of oxydization caused by ozone. This process is repeated so that the surface of the materials is subjected to gradual and intensive ionization to activate the materials deep into the inside of the passage or chamber. More particularly, even if the down is shriveled and folded by degreasing and washing processes, the repeated operations by which the down is ionized in ionized air and then brought into contact with normal to suspend the progress of oxydization caused by ozone several times lead the down to gradual and progressive ionization. The refreshed down turns activated and recovers the original elasticity as if it were covering living fowls. The fiber texture turns into an expanded state. The electrostatic charge is removed.

In this manner, the down recovers its original state such that it can float in the breeze. Thus, such down floats well in the breeze in the selection room to be easily selected from feathers which are difficult to float in the breeze. Likewise, even wornout down can be activated to be soft and bulky in the same manner as reprocessed cotton.

Further, the materials to be treated are placed in a chamber which is alternately filled with ionized air and normal air from nozzles for ionized air and nozzles for normal air, respectively, to refresh and activate the materials.

In accordance with the present invention, such gradually and progressively repeated ionization of the materials prevents the materials from rapid oxidation caused by high concentration of ozone. Thus, the sufficient extent of progress of ionization causes the cellular tissues to be effectively activated.

DESCRIPTION OF PREFERRED EMBODIMENTS

Figure 1:
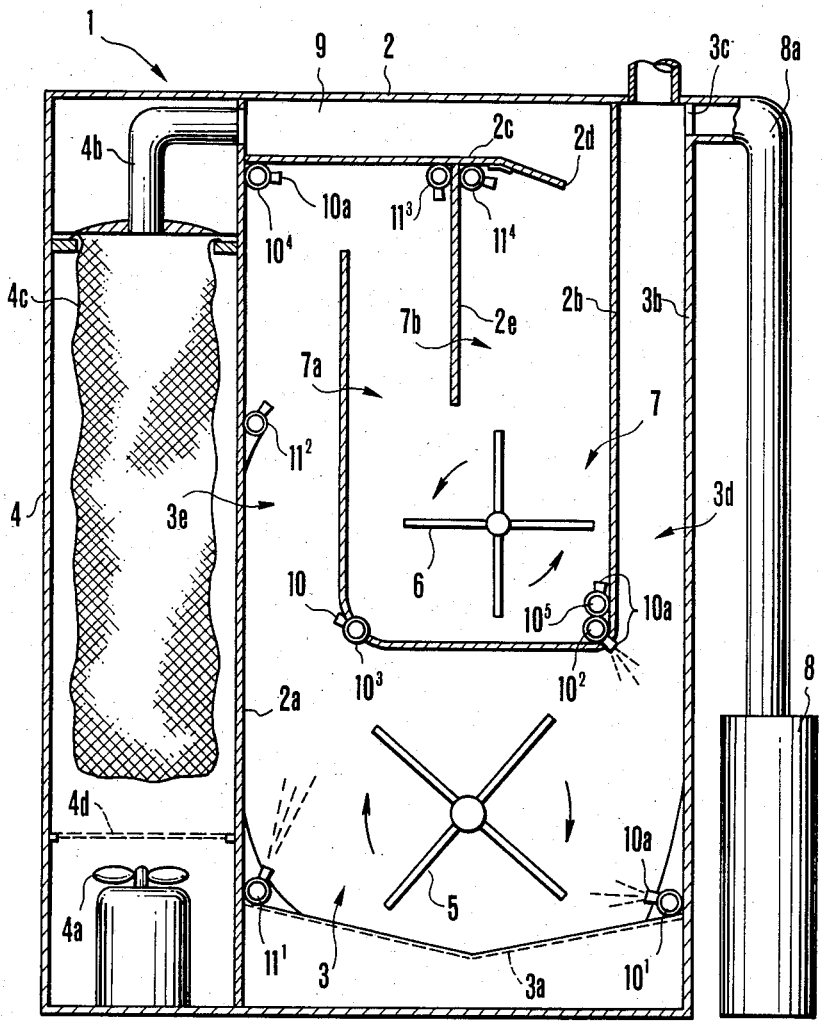
FIG. 1 is a front view of a down activating apparatus for use in a first embodiment of the present invention.

A first embodiment of the present invention concerning treatment of down will now be described in detail. FIG. 1 is a cross-sectional view of an apparatus for use in the implementation of the present invention. A down activating apparatus 1 includes a metal box 2 which is divided into a primary treating chamber 3 and a collection chamber 4 by a partition wall 2*a*.

The primary treating chamber 3 includes a grate 3*a* which is disposed at a position near the bottom and spaced by a predetermined distance from the bottom. A set of lower rotatable feeding blades 5 are disposed above the grate 3a. Upper rotatable feeding blades 6 are disposed above the lower rotatable feeding blades 5 and the upper rotatable feeding blades 6 are surrounded by a partition wall 2b in the form of a substantial U-shape as viewed from the front direction to form a secondary treating chamber 7.

An inlet 3c is formed at an upper end of a right outer wall 3b of the chamber 3. A down and feathers feeding hose 8a is coupled with the inlet 3c. The outer end of the hose 8a is coupled with the down and feathers feeding device 8. Thus, a predetermined space between the secondary treating chamber 7 and the outer wall 3b forms an incoming path 3d and a predetermined space between the secondary treating chamber 7 and the partition wall 2a forms an upwardly flowing path 3e.

A partition plate 2c is extended above the secondary treating chamber 7 to form a ceiling and also to form an exhaust outlet 2d at a right side of the partition plate 2c. An exhaust path 9 is formed between an upper wall of the box 2 and the partition plate 2c. The partition plate 2c is provided with a vertical wall 2e which hangs down from the partition plate 2c into the secondary treating chamber 7 so that the upper portion of the secondary treating chamber 7 is divided into an incoming path 7a and an outgoing path 7b.

Air ionizers $10^1$ and $10^2$ are disposed at a lower right corner of the chambers 3 and 7, respectively, so that both nozzles 10a thereof are directed to the chamber 3.

Figure 2:
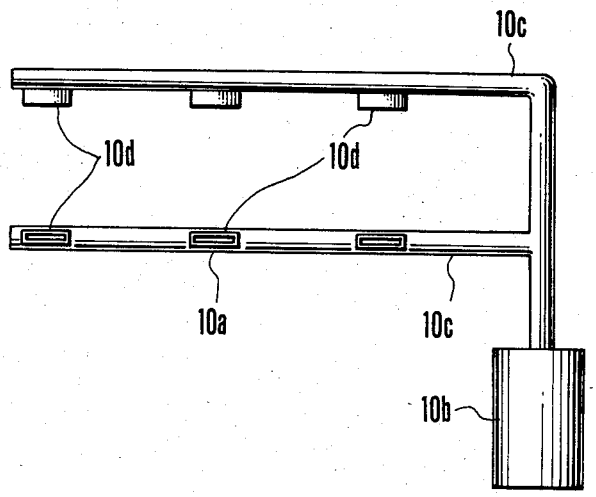
FIG. 2 is a side view of an air ionizer.
Figure 3:
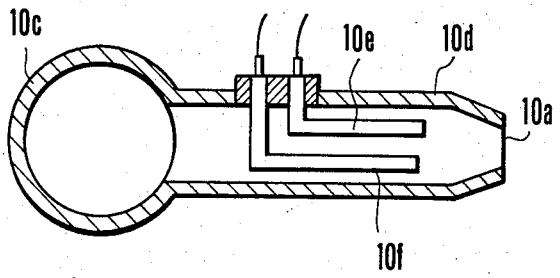
FIG. 3 is a cross-sectional view of a nozzle for ionized air of the air ionizer.

Referring to FIGS. 2 and 3, the air ionizers $10^1$ and $10^2$ are provided with an air compressor 10b which is coupled with a base end of branched blower pipes 10c. The blower pipes 10c are provided with a plurality of injection pipes 10d. The injection pipe 10d includes a pair of positive and negative corona electrodes 10e and 10f. When a voltage is applied between both the corona electrodes 10e and 10f, a corona discharge is generated therebetween. When air is blown from the air compressor 10b, ionized air is injected into the chamber 3 from the nozzles 10a.

A nozzle $11^1$ is disposed in a lower left corner of the chamber 3 in FIG. 1 so that the nozzle $11^1$ blows out normal air toward the upper right direction. The base end of the nozzle $11^1$ is coupled with an air compressor, not shown, outside of the chamber 3 so that normal air is sent into the chamber 3. Thus, the nozzles 10a for ionized air and the nozzles $11^1$, $11^2$, $11^3$ and $11^4$ for normal air are alternately disposed in the path of the materials from the chamber 3 to the outlet 2d of the chamber 7 at proper intervals as shown in FIG. 1.

A suction fan 4a is disposed at the lower portion of the collection chamber 4. An exhaust pipe 4b which communicates with the exhaust path 9 is disposed at the upper portion of the partition wall 2a, and a collection bag 4c is attached to an outlet of the exhaust pipe 4b. In FIG. 1 a grate 4d is shown as separating the collection bag 4.

The down feeding device 8 feeds 20 kg of down into the chamber 3 in ten minutes by 12 $m^3$ per second of air.

The air ionizers $10^1$ and $10^2$ in the chamber 3 blow out 4 $m^3$ per second of ionized air into the chamber 3. Other air ionizers $10^3$, $10^4$ and $10^5$ each possess a capacity of blowing out 1 $m^3$ per second of ionized air. The nozzles $11^1$ to $11^4$ for normal air each can blow out 1 to 2 $m^3$ per second of fresh air.

The suction fan 4a of the collection chamber 4 possesses a suction capacity of about 16 $m^3$ per second to suck the down in the chamber 7 and collect the down into the collection bag 4c. The collection bag 4c accommodates 20 kg of the down.

In the present apparatus 1 constructed above, the down and feathers sent out from the down feeding device 8 enter the chamber 3 through the hose 8a and the incoming path 3d. The chamber 3 is filled with ionized air generated by the corona discharge of the air ionizers $10^1$ and $10^2$. When the down and feathers come into contact with the ionized air, the surface of the down and feathers is ionized. The lower rotatable feeding blades 5 agitate the down and feathers within the chamber 3 and the down with a good floatability goes up into the path 3e while the feathers which are difficult to float stay in the bottom. The down going up into the path 3e is then immediately brought into contact with normal air sent out from the nozzle $11^1$ so that the progress of the precipitous oxydization of the down caused by ozone can be suspended. Then the down is blown upward. The down blown upward is brought into contact with ionized air and normal air, alternately, blown out of the nozzles 10a for ionized air and the nozzles $11^2$ and $11^3$ for normal air to be repeatedly subjected to ionization and immediate subsequent suspension of the progress of oxydization caused by ozone alternately until the down enters the chamber 7. When the down enters the chamber 7, the down is agitated by the upper rotatable feeding blades 6. The down is further ionized by the ionized air blown out of the nozzle 10a and is floated. Then, the down comes into immediate contact with normal air blown out of the nozzle $11^4$ and reaches the outlet 2d. The down reaching the outlet 2d is sucked into the exhaust path 9 by the suction fan 4a in the collection chamber 4 and is collected into the bag 4c through exhaust pipe 4b.

Corona discharge by air ionizers $10^1$ and $10^5$ ionizes air. The ozone $O_3$ in the ionized air is decomposed into $O_2$ and O of which two atoms are easily converted into an oxygen molecule $O_2$. The surface of the down is subjected to strong oxidization when oxygen atoms generated from ozone become oxygen molecules. Accordingly, the surface of the down once ionized to be activated is subjected to acute oxidization and then immediately prevented from the progress of oxydization by normal air to be further ionized in contact with ionized air. Thus, the down is subjected to progressively repeated ionization and then immediate through gradual ionization instead of one time acute ionization while being kept from oxydization caused by ozone. The down thus ionized is restored to its original shape is activated and then recovers its original elasticity from the state of being shrinked, folded, stretched or entangled. The down which is intertwined with each other is separated from each other when ionized. The down easily floats in the breeze, while the feathres are difficult to float in the breeze and fall down. The selection rate of the down from the feathers becomes 99% according to the present method while the selection rate of the prior art method is about 60%, which necessitates that the selection process be repeated.

In addition, since the activated down, which has shown a phenomenon of age to become shrinked, stretched or folded, recovers its original shape and increases its bulkiness, the collection bag 4c accommodates only 9 kg of down, while the same bag 4c can accommodate 20 kg of down treated by conventional methods. Accordingly, while the down-filled quilt according to conventional methods contains 1.5 kg of down, the quilt which is filled with 1 kg of the activated down according to the present invention is too bulky for the quilt. Therefore 700 to 800 g of the activated down is enough to assure the same bulkiness as the quilt filled with the down according to conventional methods.

The present invention is not limited to the above construction. The materials to be treated may be contained in a bucket to pass through a tunnel and nozzles may be disposed so that ionized air and normal air are alternately blown out.

The present invention is not limited to the treatment of down as described above and can also be utilized to activate cotton, chemical fibers, silk and the like.

Figure 4:
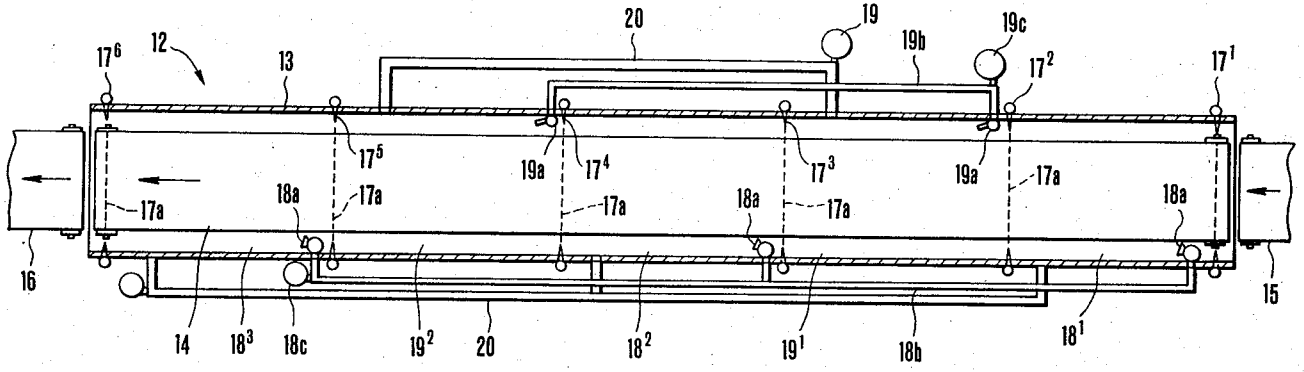
FIG. 4 is a plan view of an activating apparatus for use in a method of a second embodiment.

FIG. 4 is a plan view of an apparatus used in a method of a second embodiment.

A down activating device 12 includes a conveyor 14 disposed at the bottom of a plane and rectangular housing 13 and moved in the longitudinal direction. A carrying-in conveyor 15 and a carrying-out conveyor 16 are disposed in series before and behind the conveyor 14.

Air curtain units $17^1$, $17^2$ . . . , $17^6$ are disposed in the housing 13 at predetermined intervals and air curtains 17*a* are used to define ionized air chambers $18^1$ to $18^3$ and normal air chambers $19^1$ to $19^2$, alternately.

Each of the ionized air chambers $18^1$ to $18^3$ is provided with an ionized air nozzle 18*a* of an an ionizer which is identical with that shown in FIG. 3 and described in the first embodiment. In FIG. 4, there is also shown an air pipe 18*b* and an air pump 8*c*.

Each of the normal air chambers $19^1$ and $19^2$ is provided with an air nozzle 19*a* coupled with an air pump 19*c* through an air pipe 19*b*, and an exhaust pipe 20 is further disposed between the normal air chambers $19^1$ and $19^2$.

When the materials such as silk thread, woolen yarn, chemical fiber yarn, cotton, blankets, paper and wood are carried into the housing 13 by the carrying-in conveyor 15, the materials are moved in the housing 13 by the conveyor 14 at a predetermined speed. The housing 13 is divided into the ionized air chambers $18^1$ to $18^3$ and the normal air chambers $19^1$ and $19^2$, which are alternately disposed, by the air curtains 17*a*. The ionized air is blown into the ionized air chambers $18^1$ to $18^3$ from the nozzles 18*a* to adjust the quantity of the blown out ionized air to be $4m^3$ per second. The materials have their surface ionized while passing through the ionized air chamber $18^1$. Consequently the materials are immediately moved to the normal air chamber $19^1$ to have the progress of oxydization caused by ozone suspended temporarily by fresh normal air. The materials are then transferred to the ionized air chamber $18^2$ to be ionized therein again. In this manner, the ionized air chambers $18^1$ to $18^3$ and the normal air chambers $19^1$ and $19^2$ are alternately disposed within the housing 13 so that the materials passing through the housing 13 are ionized and then immediately have the progress of oxydization caused by ozone suspended with normal air alternately and repeatedly, resulting in gradually intensified ionization. The conveyor 16 carries out the materials. In the above construction, the ionized air was blown into the ionized air chambers $18^1$ to $18^3$ at the rate of 4 $m^3$ per second. The conveyor 14 is stationed in each chamber for three minutes to treat 20 kg of silk thread. The treated silk thread was thicker than before treatment and had a feeling like fluffy floss silk. The silk thread seemed to have increased its volume by about 20% or more.

Worn-out neckties each made of silk, polyester fiber and wool recovered their bulkiness as if they had been new ones, when treated under the same conditions, although they had flat folded edges before treatment.

Figure 5:
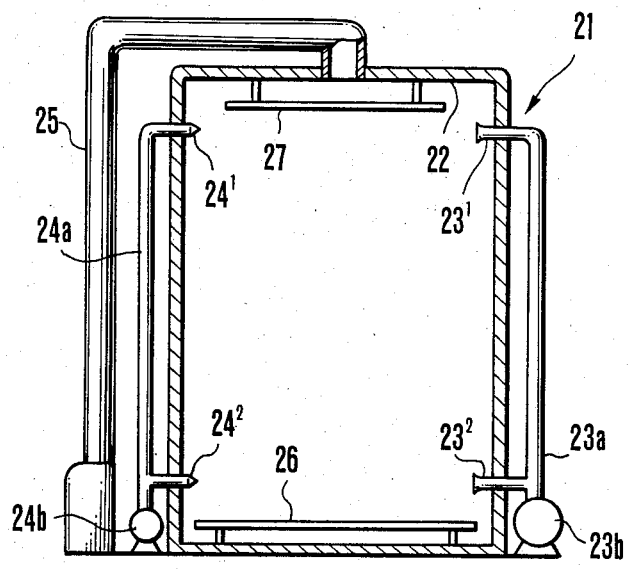
FIG. 5 is a cross-sectional view of an activating apparatus for use in a method of a third embodiment.

FIG. 5 is a cross-sectional view of an apparatus for use in a method of the third embodiment.

An activating device 21 includes ionized air nozzles $23^1$ and $23^2$ coupled with an air ionizer and air nozzles $24^1$ and $24^2$ for feeding normal air which are disposed in a rectangular box 22.

The box 22 is further provided with an exhaust device 25. In FIG. 5, there is also shown air pipes 23*a* and 24*a*, air pumps 23*b* and 24*b*, a pedestal 26, and a hanger 27. The activating device 21 can interchange the ionized air and the normal air at predetermined intervals alternately. A basket which contains cotton yarn, quilts, paper, books, wood or the like is laid on the pedestal 26 and blankets, clothes, coats, quilts or the like are hung on the hanger 27 for treatment.

Used cotton-filled quilts were hung on the hanger 27. The ionized air nozzles $23^1$ and $23^2$ blew out the ionized air at the rate of 5 $m^3$ per second for five minutes and the ionized air was then evacuated by the exhaust device 25. The air pipes $24^1$ and $24^2$ blow out normal air for four minutes and the normal air was then evacuated. Then again, the nozzles $23^1$ and $23^2$ blew out the ionized air at the rate of 5 $m^3$ per second for five minutes and the same conditions as above were thus repeated five times. Consequently, cotton shriveled hard recovered its original elasticity and became bulkier and softer than that dried in the sun for three hours. The cotton was thus activated and refreshed.

Further, when a worsted suit was treated on the same conditions, the hard shriveled worsted cloth was restored to its bulkiness and softness and was activated as if it had been new.

While there has been described what is at present considered to be preferred embodiments of the invention, it will be understood that various modifications may be made therein, and it is intended that the appended claims cover all such modifications as fall within the true spirit and scope of the invention.

What is claimed is:

1. A method of activating down and fiber materials having interiors and external surfaces, comprising the steps of:

applying ionized air to external surfaces of down and fiber materials via a plurality of nozzles coupled with at least one ozonizer;

applying immediately thereafter normal air to said external surface of the down and the fiber materials via a plurality of nozzles coupled with a compressed air source; and repeating alternately the steps of applying ionized air and applying immediately thereafter normal air to said external surfaces of the down and fiber materials;

whereby said external surfaces of the down and fiber materials effectively recover their original elasticity but the down and fiber materials are prevented from being oxidized by the ionized air.

2. The method as defined in claim 1, further comprising the steps of:

feeding the down and fiber materials preliminarily into a passage;

stirring the down and fiber materials simultaneously with the steps of applying ionized air and normal air; and collecting the down and fiber materials subsequently after the steps of applying ionized air and normal air are completed.

3. The method as defined in claim 1, further comprising the step of:

applying a plurality of air curtains to said down and fiber materials between the steps of applying ionized air and applying normal air.

4. The method as defined in claim 3, further comprising the steps of:

transferring the down and fiber materials through a plurality of chambers filled alternately with ionized air and normal air, said plurality of chambers being separated from each other by means for applying the plurality of air curtains.

5. The method as defined in claim 4, further comprising the step of:

stationing the down and fiber materials in each of the plurality of chambers for a predetermined duration of time.

* * * * *